US009905986B2

(12) United States Patent
Bierbaum

(10) Patent No.: US 9,905,986 B2
(45) Date of Patent: Feb. 27, 2018

(54) ASSEMBLY TOOL FOR RELEASING A LATCH ELEMENT OF A PLUG

(71) Applicant: GB GMBH—BSS, Gross-umstadt (DE)

(72) Inventor: Adalbert Bierbaum, Gross-umstadt (DE)

(73) Assignee: GB GMBH—BSS, Gross-umstadt (DE)

( * ) Notice: Subject to any disclaimer, the term of this patent is extended or adjusted under 35 U.S.C. 154(b) by 0 days.

(21) Appl. No.: 14/654,521

(22) PCT Filed: Dec. 17, 2014

(86) PCT No.: PCT/EP2014/078243

§ 371 (c)(1),
(2) Date: Jun. 20, 2015

(87) PCT Pub. No.: WO2015/101500

PCT Pub. Date: Jul. 9, 2015

(65) Prior Publication Data

US 2016/0308322 A1 Oct. 20, 2016

(30) Foreign Application Priority Data

Jan. 6, 2014 (DE) ..... 10 2014 000 595

(51) Int. Cl.
*H01R 43/26* (2006.01)
*H01R 13/627* (2006.01)
(Continued)

(52) U.S. Cl.
CPC ..... *H01R 43/26* (2013.01); *H01R 13/6272* (2013.01); *H01R 24/64* (2013.01); *H01R 2107/00* (2013.01)

(58) Field of Classification Search
CPC .... G02B 6/36; G02B 6/38; G02B 6/40; B25B 27/00; H01R 43/26; H01R 13/6272; H01R 24/64; H01R 2107/00
See application file for complete search history.

(56) References Cited

U.S. PATENT DOCUMENTS 5,777,413 A * 7/1998 Nagata ..... F16C 17/08 310/156.25
7,651,361 B2 1/2010 Henry et al.
(Continued)

FOREIGN PATENT DOCUMENTS

DE 10019450 A1 10/2001
JP 2612840 B2 * 5/1997

OTHER PUBLICATIONS

German Official Action (dated Dec. 2, 2014) for corresponding German App. 102014100059.5.
(Continued)

*Primary Examiner* — Carl Arbes
(74) *Attorney, Agent, or Firm* — WRB-IP LLP

(57) ABSTRACT

The invention relates to an assembly tool for releasing a latch element of a plug that is latchingly connected to a jack, having a tool shaft and a head part arranged on the tool shaft. The head part includes two side walls disposed parallel to one another. The side walls are arranged on a profile top side of a bottom part. On a side of the side walls 5 opposite the profile top side of the bottom part, wall strips are arranged facing to one another and spaced from one another disposed parallel to the bottom part so that a receiving space for the plug is enclosed by the bottom part, the side walls and the wall strips, which space includes an opening formed between the wall strips. A cable connected to the plug can be introduced into the receiving space 8 through the opening.

6 Claims, 4 Drawing Sheets

(51) Int. Cl.
*H01R 24/64* (2011.01)
*H01R 107/00* (2006.01)

(56) References Cited

U.S. PATENT DOCUMENTS

| | | | | |
|---|---|---|---|---|
| 8,038,456 | B1 | 10/2011 | Wang | |
| 8,267,712 | B2 | 9/2012 | Huang et al. | |
| 2003/0178897 | A1 * | 9/2003 | Jun | H02K 7/081 310/90 |
| 2008/0172800 | A1 | 7/2008 | Levy | |

OTHER PUBLICATIONS

International Search Report (dated Mar. 23, 2015) for corresponding international App. PCT/EP2014/016243.

* cited by examiner

ASSEMBLY TOOL FOR RELEASING A LATCH ELEMENT OF A PLUG

BACKGROUND AND SUMMARY

The invention relates to an assembly tool for releasing a latch element of a plug which is latchingly connected to a jack. The invention farther relates to a head part of an assembly tool and to a method for releasing a plug latchingly connected to a jack by means of an assembly tool.

A plurality of plug types, such as in particular western plugs, comprise latch elements which engage with a jack adapted to the respective plug. As a result, the plug is prevented from being pulled out of or slipping out of the jack inadvertently. For releasing the plugs, latch elements usually comprise latch levers which can be operated manually in order to release the latching connection between the plug and the jack.

In particular, such plugs are used in the field of telecommunication, e.g. for network connections. For this purpose, usually so-called patch panels are used, which comprise a plurality of jacks arranged in rows adjacent to one another for receiving corresponding plugs, for example western plugs.

Connecting cables to such patch panels and in particular releasing, plugs already connected to the patch panel is very elaborate and very difficult due to the small distances between the individual jacks arranged on the patch panel since there is only little space for operating, the latch levers arranged on the plugs. For this reason, in particular rewiring such patch panels is very elaborate since first the cables already connected need to be released from the patch panel.

Therefore it is desirable to provide an assembly tool for releasing a latch element of a plug latchingly connected to a jack, as well as a head part for an assembly tool of such type and a method for releasing a plug latchingly connected to a jack by means of an assembly tool of such type so that releasing the plug front the jack is facilitated.

According to an aspect of the invention, said object is achieved by an assembly tool having a tool shaft and a head part arranged on the tool shaft, wherein the head part comprises two side walls disposed parallel to one another, wherein the side walls are arranged on a profile top side of a bottom part, wherein wall strips are arranged parallel to the bottom part facing one another and spaced from one another. On a side of the side walls opposite the profile top side of the bottom part so that a receiving space for the plug is enclosed by the bottom part, the side walls and the wall strips, which space comprises an opening formed between the wall strips, wherein through the opening a cable connected to the plug can be introduced into the receiving space. An assembly tool of such type can readily be positioned on a plug latchingly connected to a jack by first moving the assembly tool in direction of the jack, wherein a cable connected to the plug is put through the opening formed between the wall strips into the receiving space, which cable is moved through the receiving space when moving the assembly tool in direction of the jack until the plug is located in the jack. Then, the latch lever arranged on the plug can be operated by means of a corresponding tilting movement and the plug can be pulled out of the jack by pulling on the cable connected to the plug. This way, a simple release of the plug latchingly connected to the jack is facilitated. A manual and—due to the usually little space available—difficult disengagement using the fingers is no longer required when using the assembly tool according to an aspect of the invention.

The use of the assembly tool according to an aspect of the invention is particularly suited for western plugs which comprise a latch lever for actuating the latch element. For releasing a latch element of such type, advantageously the plug is introduced into the receiving space of the head part such that the latch lever of the latch element is oriented, in direction toward the bottom part and that it can be brought in abutment with the bottom part.

The tool shaft of the assembly tool may be configured for the respective requirements and, advantageously, is oriented at least sectionally parallel to a longitudinal axis of the head part. According to an aspect of the invention, the tool shaft usually extends completely parallel the longitudinal axis.

It is also possible and provided according to an aspect of the invention that the tool shaft is configured at least sectionally bent or angled. This way, the assembly tool facilitates an easier insertion and removal of plugs under certain installation conditions. For example, an assembly tool having an angled tool shaft may be used for jacks that are arranged in connection sockets embedded in the ground.

The tool shaft advantageously comprises as handle on an end section. Opposite the head part. Advantageously, the head part is made of an antistatic material so that a grounding of the assembly tool during installation and removal is not required. According to an aspect of the invention, the head part is made of a synthetic material.

In order to be able to release different types of plugs by means of the assembly tool, it is provided according to an aspect of the invention that the head part is connected to the tool shaft in a releasable manner. This way, head parts adapted to the respective plug may readily be connected to the tool shaft.

In a particularly advantageous embodiment of the head part of an assembly tool as described above, it is provided according to an aspect of the invention that on a front edge of the bottom part an abutment section is formed running inclined from a profile bottom side of the bottom part facing away from the side walls to the profile top side of the bottom part in direction of a rear edge of the bottom part opposite the front edge. For releasing a plug having a latch lever arranged on the plug latchingly connected to a jack by means of an assembly tool having a head part with an inclined abutment section, first the assembly tool is moved in direction of the jack, wherein a cable connected to the plug is guided through the receiving space. Once the plug extends into the receiving space the inclined abutment section is brought in abutment with the latch lever of the latch element of the plug and the assembly tool is moved further in direction of the jack, wherein the latch lever is gradually guided along the inclined abutment section and displaced in direction of an unlocking position of the latch element until the latching connection between the latch element and the jack is released. This way, a tilting movement of the assembly tool for releasing the latching connection is not required.

In another particularly advantageous embodiment of the head part of an assembly tool as described above it is provided according to an aspect of the invention that an abutment element is arranged on the head part spaced from a front edge of the head part on a side facing the profile top side of the bottom part. This way, a plug to be released can readily be brought in abutment with the abutment element and thus be arranged in a predefined position inside the receiving space so that an only slight tilting, movement is required for actuating the latch lever and for releasing the latching connection between the plug and the jack.

In order to be able to guide a cable connected to a plug to be released readily through the receiving space of the head part and across over the head part, it is provided according to an aspect of the invention that the abutment element is arranged spaced from the wall strips on the head part.

The assembly tool equipped with the head pan according to an aspect of the invention can particularly easy be moved toward a plug to be released in that a cable connected to the plug is guided through the head part in longitudinal direction with respect to a longitudinal axis of the plug. For this purpose, it is advantageously provided, according to an aspect of the invention that the abutment element comprises a recess which extends over the entire length of the abutment element and which faces an opening formed between the wall strips.

According to an aspect of the invention, an easy guidance of the cable through the bead part is also possible by arranging the abutment element adjacent to or spaced from the side walls on the bottom part.

In order to be able to readily connect the bead part to the tool shaft of the assembly tool it is provided according to an aspect of the invention that a receiving facility is formed on the bottom part for receiving the tool shaft. For example, the receiving facility may be a threaded hole, wherein an external thread adapted to the threaded hole is formed on the tool shaft.

The invention also relates to a method for releasing a plug latchingly connected to a jack by means of an assembly tool as described above, wherein the assembly tool comprises a head part as described above. In the method according to an aspect of the invention, advantageously in a first step the cable connected to the plug is guided through the opening into the receiving space, wherein in a second step the assembly tool is moved in the direction of the plug, wherein the cable is guided through the receiving space until the plug is located in the receiving space and wherein in a third step the latching connection between the plug and the jack is released so that the plug can be pulled out of the jack by pulling on the cable.

According to an aspect of the invention, it is advantageously provided that for releasing the latching connection, in a third step the assembly tool is tilted in a predefined direction, bringing a latch element of the plug in abutment with the bottom part, thus releasing the latching connection. Usually, the bottom part of the plug is brought in abutment with a latch lever of the latch element.

The assembly tool described above is naturally also suited for locking plugs into or latchingly connecting them to respective jacks. For this purpose, the method steps described may be performed in reverse order, for example.

BRIEF DESCRIPTION OF THE DRAWINGS

Further advantageous embodiments of the assembly tool according to an aspect of the invention, of the head parts according to an aspect of the invention as well as of the method according to an aspect of the invention will be explained in further detail by means of the embodiments shown in the drawing.

The drawings show in.

DETAILED DESCRIPTION

Figure 1:
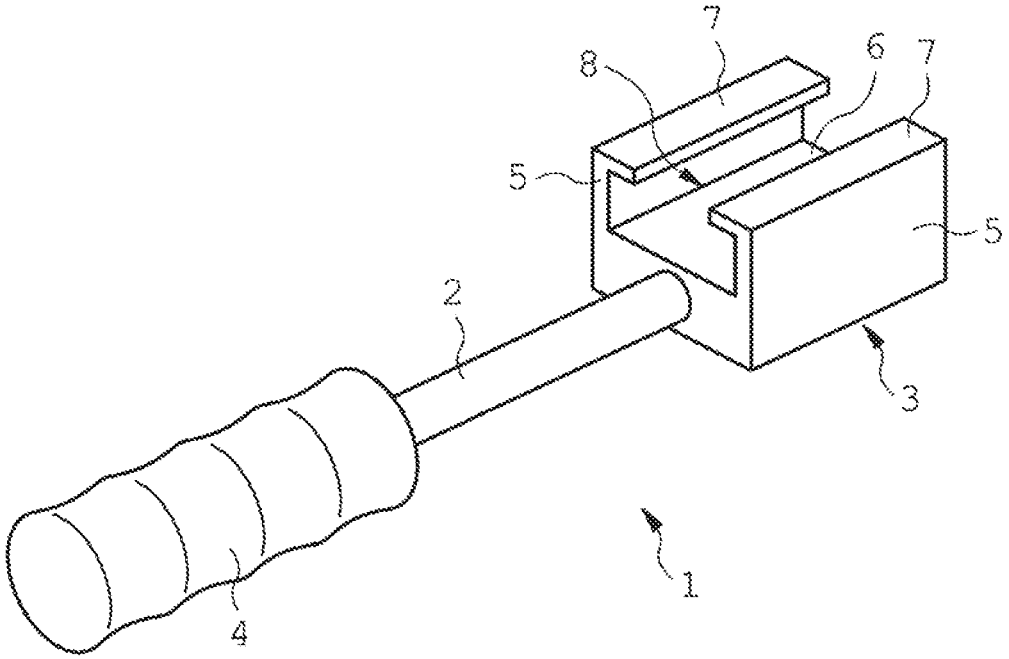
FIG. 1 a schematic illustration of an assembly tool.

FIG. 1 schematically shows an assembly tool 1 having a tool shaft 2 and a head part 3 arranged on the tool shaft 2. A handle 4 is arranged on an end section of the tool shaft 2 opposite the head part 3. The head part 3 comprises two side walls 5 disposed parallel to one another which are arranged on a bottom part 6. In each case one wall strip 7 is arranged on the side walls 5.

According, to an aspect of the invention, the dimensions of the bottom part 6, the side walls 5 as well as the wall strips 7 are provided such that a plug (not shown) located inside a receiving space 8 formed by the side walls 5, the bottom part 6 and the wall strips 7 essentially completely abuts the side walls 5 and the wall strips 7 and that a latch lever of a latch element of the plug located inside the receiving space abuts the bottom part 6 or can be brought in abutment by means of a tilting movement.

Figure 2A:
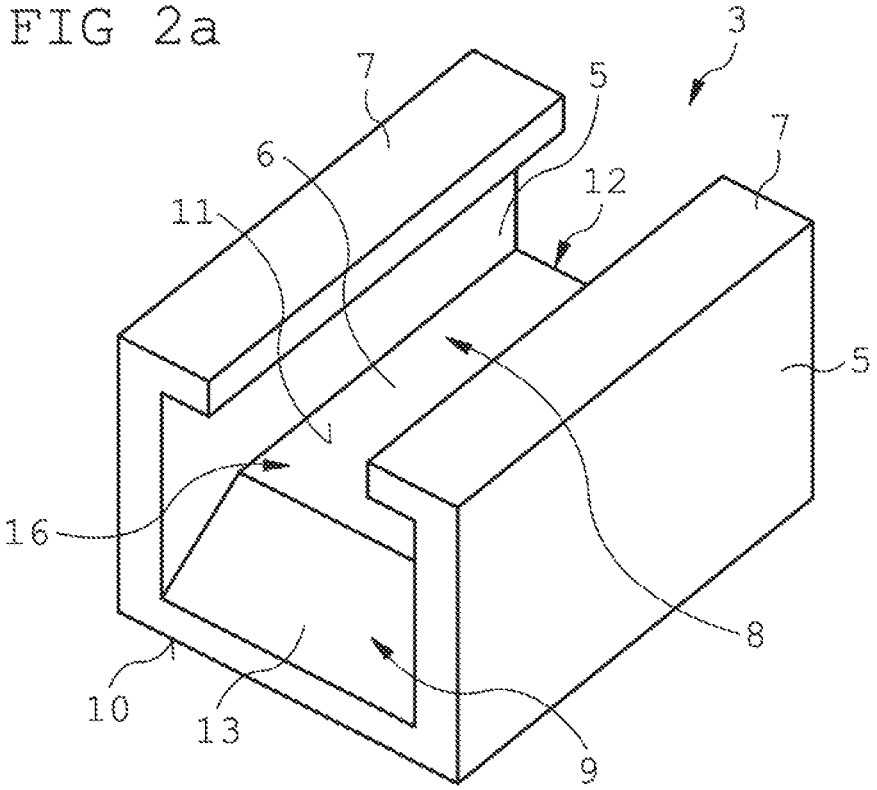
FIG. 2*a* a schematic illustration of a head part having an inclined abutment section, FIG. 2*b* a schematic sectional view of a head part having an inclined abutment section and a plug located inside a receiving space, FIG. 3*a* a schematic illustration of a head part having an abutment element, FIG. 3*b* a schematic sectional view of a head part having an abutment element and of a plug located inside a receiving space, and FIG. 4 a schematic illustration of an assembly tool moved toward the patch panel for releasing a plug connected to a jack of a patch panel.

FIG. 2*a* schematically shows a head part 3 wherein an abutment section 13 is formed on a front edge 9 of a bottom part 6 running, inclined from a profile bottom side 10 of the bottom part 6 to a profile top side 11 of the bottom part 6 in direction of a rear edge 12 of the bottom part 6 opposite a front edge 9. A receiving space 8 for receiving a plug 14 is formed by the bottom part 6, the side walls 5 and the wall sections 7 as can be seen from the schematical sectional view in FIG. 2*b*.

Figure 2B:
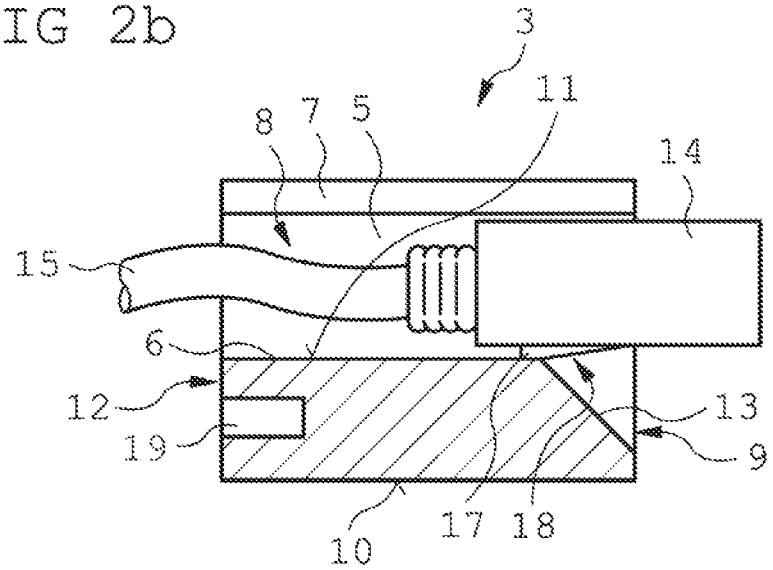

For releasing the plug, first an assembly tool equipped with a head pan as illustrated in FIGS. 2*a* and 2*b* is moved in direction of a jack connected to the plug to be released 14 (not shown in FIGS. 2*a* and 2*b*), wherein a cable 15 connected to the plug 14 is guided through the receiving space 8. In order to be able to arrange the cable 15 in the receiving space 8, first the cable 15 is guided through an opening 16 limited by the wall sections 7.

Once the plug 14 to be released is located at least sectionally in the receiving space 8, the inclined abutment section 13 abuts a latch lever 17 of a latch element 18 of the plug 14. If now the assembly tool is moved further in direction of the jack, the latch lever 17 is displaced further along the inclined abutment section 13 in direction of an unlocking position of the latch element 18 until the latching connection between the plug 14 and the jack is released. In the position as shown in FIG. 2*b*, the latch lever 17 is in the unlocking position already so that the plug 14 can be removed from the jack by pulling on the cable 15.

For connecting the head part 3 to a shaft 2 of an assembly tool 2, a receiving facility 19 is formed on the bottom part 6.

Figure 3A:
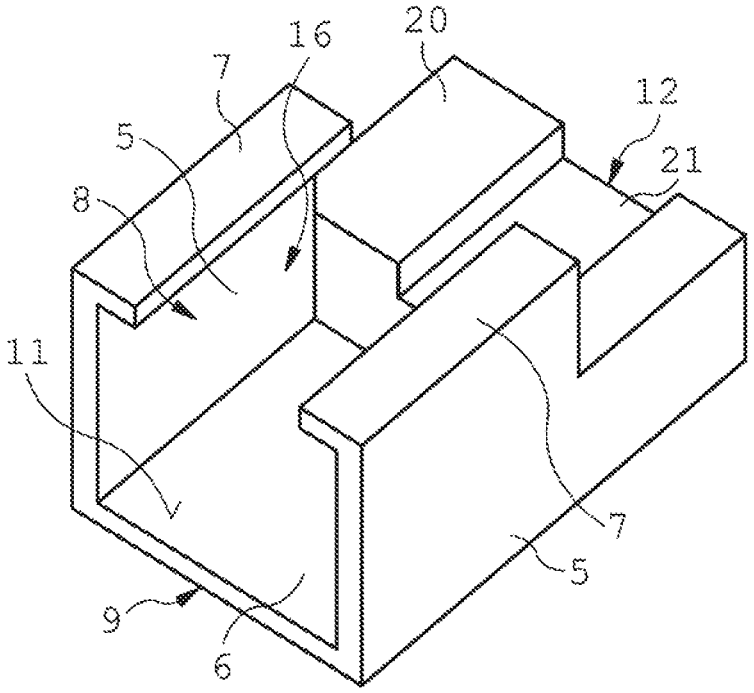
Figure 3B:
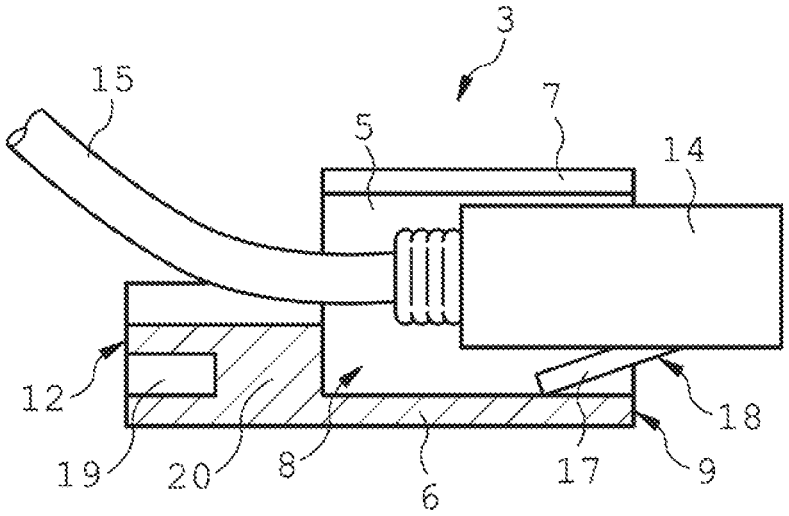

FIG. 3*a* schematically shows a head part 3 having an abutment element 20. The abutment element 20 is arranged adjacent to side walls 5 of the head part 3 on a bottom part 6 of the head part 3. The abutment element 20 comprises a recess 21 extending over the entire length of the abutment element 20, through which recess can be guided a cable 15 connected to a plug 14 to be released as can be seen from the schematical sectional view of the head part 3 shown in FIG. 3*b*.

Figure 4:
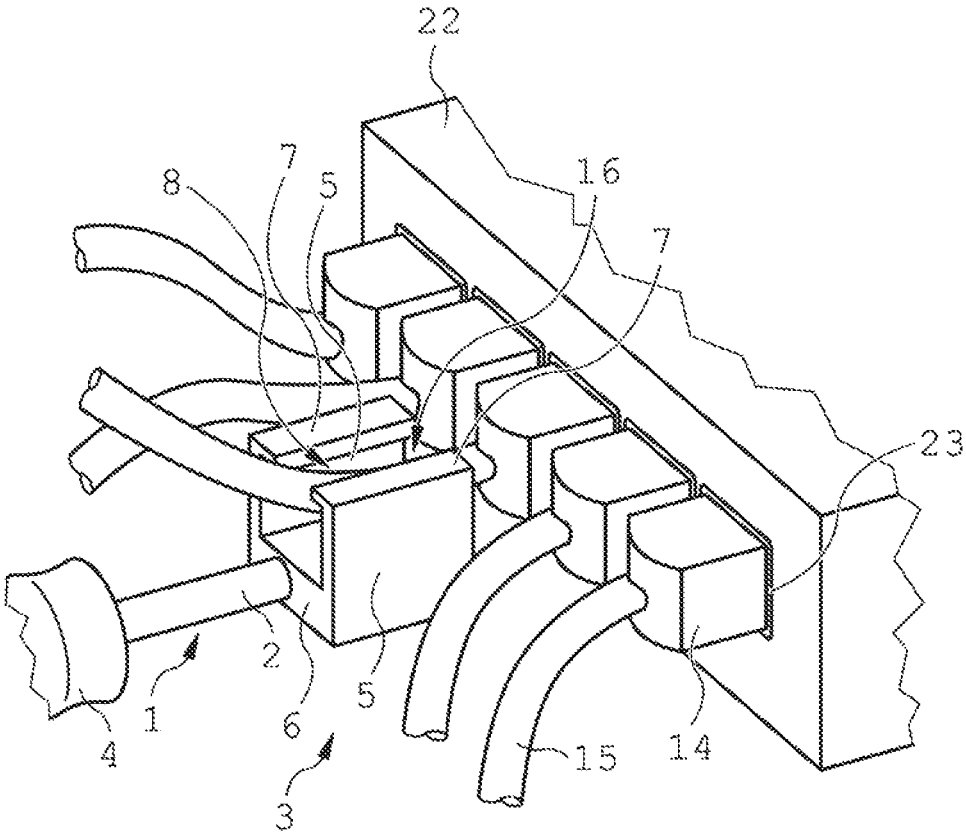

FIG. 4 shows a schematical illustration of a patch panel 22 having a plurality of jacks 23 arranged in rows adjacent to one another, wherein in each case plugs 14 connected to cables 15 are arranged in the jacks 23 in a latching manner. In the illustration of FIG. 4, in each case one jack 23, one plug 14 and one cable 15 are marked with a reference numeral in an exemplary manner.

Further, FIG. 4 schematically shows an assembly tool 1 which for releasing an individual plug 14 is moved in direction of said plug 14. For this purpose, the cable 15 connected to the plug 14 is guided through a receiving space 8 of a head part 3 of the assembly tool 1 so that the assembly tool 1 may readily be moved toward the plug 15 without damaging the plug 15 or the cable 14.

Once the plug 14 is located in the receiving space 8 of the head part 3 of the assembly tool 1, a latch element (not shown) of the plug 14 can be released by tilting the assembly tool and the plug 14 can be removed from the jack 23 by pulling on the cable 15.

The invention claimed is:

1. Head part of an assembly tool for releasing a latch element of a plug latchingly connected to, a jack, having a tool shalt and a head part arranged on the tool shaft, wherein the head part comprises two side walls disposed parallel to one another, wherein the side walls are arranged on a profile top side of a bottom part, wherein wall strips are arranged on a side of the side walls opposite the profile top side of the bottom part parallel to the bottom part facing one another so that a C-shaped receiving space for the plug is enclosed by the bottom part, the side walls and the wall strips, which space comprises an opening formed between the wall, strips, wherein a cable connected to the plug can be introduced into the receiving space through the opening, wherein, in the head part, an abutment section is formed on a front edge of the bottom pan which section runs inclined from a profile bottom side of the bottom part facing away from the side walls to the profile top side of the bottom part in direction of a rear edge of the bottom part opposite the front edge.

2. Head part of an assembly tool according to claim 1, wherein an abutment element spaced from a front edge of the head pan is arranged on a side facing the profile top side of the bottom part on the head part.

3. Head part according to claim 2, wherein the abutment element is arranged spaced from the wall strips on the head part.

4. Head part according to claim 2, wherein the abutment element comprises a recess extending over the entire length of the abutment element and facing an opening formed between the wall strips.

5. Head part according to claim 2, wherein the abutment element is arranged adjacent to or spaced from the side walls on the bottom part.

6. Head part according to claim 2, wherein a receiving structure for receiving the tool shaft is formed on the bottom part.

* * * * *